US009064617B2

(12) United States Patent
Marui et al.

(10) Patent No.: US 9,064,617 B2
(45) Date of Patent: Jun. 23, 2015

(54) ELECTRICALLY CONDUCTIVE RUBBER COMPOSITION, DEVELOPING ROLLER, AND IMAGE FORMING APPARATUS

(71) Applicant: SUMITOMO RUBBER INDUSTRIES, LTD., Kobe-shi, Hyogo (JP)

(72) Inventors: Takashi Marui, Kobe (JP); Yoshihisa Mizumoto, Kobe (JP); Kei Tajima, Kobe (JP)

(73) Assignee: SUMITOMO RUBBER INDUSTRIES, LTD., Kobe-Shi (JP)

( * ) Notice: Subject to any disclaimer, the term of this patent is extended or adjusted under 35 U.S.C. 154(b) by 175 days.

(21) Appl. No.: 13/939,298

(22) Filed: Jul. 11, 2013

(65) Prior Publication Data

US 2014/0103262 A1 Apr. 17, 2014

(30) Foreign Application Priority Data

Oct. 12, 2012 (JP) ..... 2012-227242

(51) Int. Cl.
*H01B 1/24* (2006.01)
*G03G 15/08* (2006.01)

(52) U.S. Cl.
CPC ..... *H01B 1/24* (2013.01); *G03G 15/0818* (2013.01); *G03G 15/08* (2013.01)

(58) Field of Classification Search
CPC ..... H01B 1/04; H01B 1/24; G03G 15/06; G03G 15/08; G03G 15/0818; G03G 15/1685
See application file for complete search history.

(56) References Cited

U.S. PATENT DOCUMENTS

| | | | | |
|---|---|---|---|---|
| 8,277,692 | B2 * | 10/2012 | Marui et al. | 252/511 |
| 2006/0280928 | A1 * | 12/2006 | Imasaka et al. | 428/304.4 |
| 2011/0281703 | A1 | 11/2011 | Tajima et al. | |
| 2012/0202663 | A1 * | 8/2012 | Mizumoto et al. | 492/18 |
| 2013/0089362 | A1 * | 4/2013 | Kuroda et al. | 399/286 |
| 2014/0113783 | A1 * | 4/2014 | Mizumoto et al. | 492/18 |

FOREIGN PATENT DOCUMENTS

| | | | |
|---|---|---|---|
| JP | 2011-257723 | A | 12/2011 |
| JP | 2012-163776 | A | 8/2012 |
| JP | 2013-139490 | A | 7/2013 |

* cited by examiner

*Primary Examiner* — Mark Kopec
(74) *Attorney, Agent, or Firm* — Birch, Stewart, Kolasch & Birch, LLP

(57) ABSTRACT

The electrically conductive rubber composition contains a rubber component including an SBR, an epichlorohydrin rubber and a CR, and the proportion of the SBR is 40 to 80 parts by mass based on 100 parts by mass of the rubber component. The rubber composition further contains 1.0 to 1.5 parts by mass of a sulfur crosslinking agent, 0.2 to 0.6 parts by mass of a thiourea accelerating agent, 0.1 to 0.5 parts by mass of a thiuram accelerating agent, and 1.0 to 2.0 parts by mass of a thiazole accelerating agent based on 100 parts by mass of the rubber component.

3 Claims, 1 Drawing Sheet

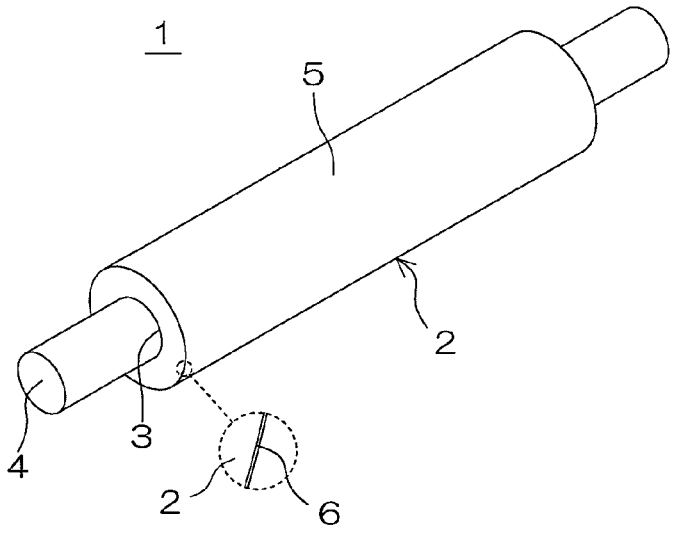
1
5
2
3
4
2
6

ELECTRICALLY CONDUCTIVE RUBBER COMPOSITION, DEVELOPING ROLLER, AND IMAGE FORMING APPARATUS

TECHNICAL FIELD

The present invention relates to an electrically conductive rubber composition, a developing roller which includes a roller body formed from the electrically conductive rubber composition and is incorporated in a developing section of an electrophotographic image forming apparatus such as a laser printer, and an image forming apparatus incorporating the developing roller.

BACKGROUND ART

Electrophotographic image forming apparatuses such as laser printers, electrostatic copying machines, plain paper facsimile machines and printer-copier-facsimile multifunctional machines have been widely prevalent with constant improvement, for example, for higher speed image formation, higher quality image formation, full-color image formation and size reduction. The improvement will be continuously made from now on.

For example, the laser printers are required to have a further reduced size and a maintenance-free feature for further prevalence thereof in the future, and research and development are constantly conducted for this purpose. To follow this trend, a developing roller to be incorporated in such a laser printer is also required to have a further reduced size.

In the developing section of the laser printer, toner is brought into contact with an outer peripheral surface of a roller body of the developing roller at a predetermined pressure by a quantity regulating blade to be thereby electrically charged and adhere to the outer peripheral surface. The toner adhering to the outer peripheral surface of the roller body is transported to a surface of a photoreceptor body by rotation of the developing roller to be thereby brought into contact with an electrostatic latent image formed on the surface of the photoreceptor body. Thus, the electrostatic latent image is developed into a toner image.

In many laser printers, the developing roller is provided together with the photoreceptor body and a toner container in the form of a cartridge, which is removably mounted in a laser printer housing. When toner in the cartridge is used up, the cartridge including the developing roller and the photoreceptor body is replaced with a new one. Thus, the laser printer is substantially free from maintenance.

The developing roller is typically produced by forming an electrically conductive rubber composition into a cylindrical body and crosslinking the rubber composition to form a roller body, and inserting a shaft such as of a metal into a center through-hole of the roller body to electrically connect and mechanically fix the shaft to the roller body.

The electrically conductive rubber composition is prepared, for example, by blending a rubber component including at least a copolymer rubber (ion-conductive rubber) containing ethylene oxide as a comonomer and having an ion conductivity and an acrylonitrile butadiene rubber (NBR), and additives such as a crosslinking agent and a crosslinking accelerating agent for crosslinking the rubber component.

In order to meet the recent requirement for further size reduction of the laser printer and to develop a compact full-color laser printer, the size of the cartridge should be further reduced.

For this purpose, the developing roller should satisfy the following requirements:

Reducing the diameter of the developing roller;

Reducing the hardness of the roller body to increase the flexibility of the roller body in order to reduce a load to the toner;

Reducing the friction coefficient of the outer peripheral surface of the roller body as much as possible in order to reduce the load to the toner; and Reducing the hardness of the roller body to maintain the compression set of the roller body at a lower level (suppressing so-called "permanent compressive deformation").

Among these requirements, the reduction of the toner load is important for so-called higher durability laser printers which are adapted to form a great number of images by using toner contained in a single cartridge.

That is, a very small part of the toner contained in the cartridge is used in a single image forming cycle, and the remaining major part of the toner is repeatedly circulated in the cartridge. Since the developing roller is provided in the cartridge and repeatedly brought into contact with the toner, the magnitude of the load (damage) to be applied to the toner by the developing roller, if any, is a critical factor that determines how long the image formation quality can be properly maintained when the same toner is repeatedly used for the image formation.

If the load is too great, the toner is liable to be deteriorated to have a broader particle size distribution due to disintegration or agglomeration of toner particles or suffer from fluctuation in charging characteristics, thereby causing a fogging phenomenon in a formed image. The fogging phenomenon is such that the deteriorated toner is spread over the background of the formed image to reduce the image quality.

As disclosed in Patent Literature 1, for example, it is effective to use a styrene butadiene rubber (SBR) capable of forming a more flexible crosslinking product than the conventional NBR in combination with the ion conductive rubber for the rubber component in order to increase the flexibility of the roller body for reduction of the toner load.

It is also effective to further blend a chloroprene rubber (CR) as the rubber component in order to control the roller resistance of the developing roller and the compression set of the roller body.

For the reduction of the friction coefficient of the outer peripheral surface of the roller body, it is effective to form an oxide film in the outer peripheral surface of the crosslinked roller body through oxidation of the crosslinking product of the electrically conductive rubber composition forming the outer peripheral surface by irradiating the outer peripheral surface of the roller body with ultraviolet radiation in an oxidative atmosphere.

The oxide film is formed through the oxidation of the crosslinking product of the electrically conductive rubber composition forming the outer peripheral surface of the roller body. Therefore, the oxide film is more uniform in thickness and surface geometry than a coating layer of the prior art formed, for example, by applying a given coating agent on the outer peripheral surface of the roller body without a problem such that dust and other foreign matter are caught in the coating layer during the formation of the coating layer.

Since the oxide film can be easily formed through the oxidation of the crosslinking product of the electrically conductive rubber composition forming the outer peripheral surface of the roller body by the irradiation with the ultraviolet radiation without additionally preparing the coating agent, it is possible to suppress the reduction in the productivity of the developing roller and the increase in production costs.

CITATION LIST

Patent Literature

[Patent Literature 1] JP-2012-163776A

SUMMARY OF THE INVENTION

Problem to be Solved by the Invention

The reduction of the friction coefficient by the formation of the oxide film is associated with the thickness and the quality of the oxide film. More specifically, a friction coefficient reducing effect is increased, as the thickness and the compactness of the oxide film increase.

A conceivable method for formation of a thicker and compacter oxide film having an excellent friction coefficient reducing effect is to significantly increase the period of the irradiation with the ultraviolet radiation or to control the crosslinking conditions to intentionally leave a great number of carbon-carbon double bonds in the crosslinked roller body to provide initiation points at which the formation of the oxide film by the irradiation with the ultraviolet radiation is started, thereby improving the efficiency of the oxide film formation by the irradiation with the ultraviolet radiation.

Unfortunately, a lower pressure mercury lamp to be used for the irradiation with the ultraviolet radiation is an expensive consumable product having a limited service life. In recent years, the percentage of the cost of the lower pressure mercury lamp with respect to the total production cost of the developing roller has been gradually increased.

Where the former method of significantly increasing the period of the irradiation with the ultraviolet radiation is employed, therefore, the consumption of the lower pressure mercury lamp is increased, resulting in frequent replacement of the lower pressure mercury lamp. Therefore, the advantage of suppressing the reduction in the productivity of the developing roller and the increase in production costs as originally intended by the formation of the oxide film will be lost.

On the other hand, the latter method is liable to reduce the crosslinking degree of the entire roller body, resulting in permanent compressive deformation of the roller body with a greater compression set.

Further, the developing roller is required to substantially prevent the contamination of the photoreceptor body and hence the reduction in image quality, which may otherwise occur due to migration of components of the roller body of the developing roller to the photoreceptor body when the roller body of the developing roller is kept in press contact with the photoreceptor body for a long period of time in the cartridge.

It is therefore an object of the present invention to provide an electrically conductive rubber composition which permits formation of an excellent oxide film having an excellent friction coefficient reducing effect by irradiation with ultraviolet radiation for a shorter period of time, and permits formation of a roller body which is soft and hence excellent in toner load reducing effect, free from contamination of the photoreceptor body and substantially free from permanent compressive deformation with a smaller compression set.

It is another object of the present invention to provide a developing roller including a roller body formed from the electrically conductive rubber composition, and to provide an image forming apparatus incorporating the developing roller.

Means for Solving the Problem

In order to achieve the above object, the inventor of the present invention conducted studies on a rubber component including three types of rubbers, i.e., an SBR, an epichlorohydrin rubber and a CR, particularly, the proportion of the SBR mainly forming the crosslinking structure of the roller body and the types and the proportions of constituents of a crosslinking component for crosslinking the rubber component including the SBR. As a result, the inventor attained the present invention.

According to an inventive aspect, there is provided an electrically conductive rubber composition, which comprises a rubber component, and a crosslinking component for crosslinking the rubber component, wherein the rubber component comprises three types of rubbers including an SBR, an epichlorohydrin rubber and a CR, and the SBR is present in a proportion of not less than 40 parts by mass and not greater than 80 parts by mass based on 100 parts by mass of the rubber component, wherein the crosslinking component includes not less than 1.0 part by mass and not greater than 1.5 parts by mass of a sulfur crosslinking agent, not less than 0.2 parts by mass and not greater than 0.6 parts by mass of a thiourea accelerating agent, not less than 0.1 cart by mass and not greater than 0.5 parts by mass of a thiuram accelerating agent, and not less than 1.0 part by mass and not greater than 2.0 parts by mass of a thiazole accelerating agent.

In the present invention, the proportions of the respective constituents are limited to the aforementioned ranges. This is based on the following ground.

If the proportion of the SBR for the rubber component is less than 40 parts by mass or if the proportion of the sulfur crosslinking agent for the crosslinking component is greater than 1.5 parts by mass or the proportion of the thiuram accelerating agent for the crosslinking component is greater than 0.5 parts by mass, the number of carbon-carbon double bonds remaining in the roller body before the irradiation with the ultraviolet radiation after the crosslinking is insufficient, making is impossible to form a thicker and compacter oxide film having an excellent friction coefficient reducing effect in the outer peripheral surface of the roller body by the irradiation with the ultraviolet radiation for a shorter period of time.

If the proportion of the sulfur crosslinking agent is less than 1.0 part by mass or the proportion of the thiazole accelerating agent is less than 1.0 part by mass, or if the proportion of the thiuram accelerating agent is less than 0.1 part by mass or the proportion of the thiourea accelerating agent is greater than 0.6 parts by mass, the roller body is liable to suffer from the permanent compressive deformation with a greater compression set.

If the proportion of the SBR is greater than 80 parts by mass or the proportion of the thiazole accelerating agent is greater than 2.0 parts by mass or if the proportion of the thiourea accelerating agent is less than 0.2 parts by mass, the roller body is liable to cause the contamination of the photoreceptor body.

Where the proportion of the SBR for the rubber component and the proportions of the four constituents of the crosslinking component are within the aforementioned specific ranges, in contrast, the electrically conductive rubber composition permits formation of an excellent oxide film having an excellent friction coefficient reducing effect by irradiation with ultraviolet radiation for a shorter period of time, and permits formation of a roller body which is soft and hence excellent in toner load reducing effect, free from contamination of the photoreceptor body and substantially free from permanent compressive deformation with a smaller compression set.

According to another inventive aspect, there is provided a developing roller, which includes a roller body produced by forming the inventive electrically conductive rubber composition into a tubular body, crosslinking the tubular body, and forming an oxide film in an outer peripheral surface of the tubular body by irradiation with ultraviolet radiation.

According to further another inventive aspect, there is provided an image forming apparatus such as a laser printer including the inventive developing roller.

The roller body is flexible because the SBR is contained as the rubber component. In addition, the roller body has an excellent oxide film formed by the irradiation with the ultraviolet radiation and having an excellent friction coefficient reducing effect. Therefore, the roller body is excellent in toner load reducing effect, free from contamination of the photoreceptor body, and substantially free from permanent compressive deformation with a smaller compression set.

With the inventive developing roller, it is possible to further reduce the size of a cartridge incorporating the developing roller for a higher durability laser printer, and the size of an image forming apparatus such as a laser printer in which the cartridge is removably mounted.

Effects of the Invention

According to the present invention, the electrically conductive rubber composition is provided which permits the formation of an excellent oxide film having an excellent friction coefficient reducing effect by the irradiation with the ultraviolet radiation for a shorter period of time, and permits the formation of a roller body which is soft and hence excellent in toner load reducing effect, free from the contamination of the photoreceptor body, and substantially free from the permanent compressive deformation with a smaller compression set. Further, the developing roller including the roller body formed from the electrically conductive rubber composition, and the image forming apparatus incorporating the developing roller are provided.

BRIEF DESCRIPTION OF THE DRAWING

FIG. 1 is a perspective view illustrating a developing roller according to an embodiment of the present invention.

EMBODIMENTS OF THE INVENTION

Electrically Conductive Rubber Composition

The inventive electrically conductive rubber composition contains a rubber component, and a crosslinking component for crosslinking the rubber component. The rubber component includes three types of rubbers including a styrene butadiene rubber (SBR), an epichlorohydrin rubber and a chloroprene rubber (CR). In the rubber component, the styrene butadiene rubber is present in a proportion of not less than 40 parts by mass and not greater than 80 parts by mass based on 100 parts by mass of the rubber component. The crosslinking component includes not less than 1.0 part by mass and not greater than 1.5 parts by mass of a sulfur crosslinking agent, not less than 0.2 parts by mass and not greater than 0.6 parts by mass of a thiourea accelerating agent, not less than 0.1 part by mass and not greater than 0.5 parts by mass of a thiuram accelerating agent, and not less than 1.0 part by mass and not greater than 2.0 parts by mass of a thiazole accelerating agent.

<Rubber Component>

(SBR)

Usable as the SBR are various SBRs synthesized by copolymerizing styrene and 1,3-butadiene by an emulsion polymerization method, a solution polymerization method, and the like. The SBRs include those of an oil-extension type having flexibility controlled by addition of an extension oil, and those of a non-oil-extension type containing no extension oil. Either type of SBRs is usable.

According to the styrene content, the SBRs are classified into a higher styrene content type, an intermediate styrene content type and a lower styrene content type, and any of these types of SBRs is usable. Physical properties of the roller body can be controlled by changing the styrene content and the crosslinking degree.

Particularly, SBRs having a styrene content of 20 to 40% and a Mooney viscosity of 30 to 60 ML1+4 (at 100° C.) are preferred.

These SBRs may be used either alone or in combination.

The proportion of the SBR to be blended is limited to a range of not less than 40 parts by mass and not greater than 80 parts by mass based on 100 parts by mass of the rubber component. By thus limiting the proportion of the SBR to the aforementioned range and limiting the proportions of the respective constituents of the crosslinking component to specific ranges to be described later, the effects of the present invention previously described can be provided.

For further improvement of the effects, the proportion of the SBR is preferably not less than 50 parts by mass within the aforementioned range based on 100 parts by mass of the rubber component.

Where two or more types of SBRs or two or more types of other rubber ingredients are used in combination for each of the constituents of the rubber component or where two or more types of ingredients are used in combination for each of the constituents of the crosslinking component, the proportions of the SBR and other constituents are each defined as the total proportion of the two or more types of ingredients. Where a single type of ingredient is used for each of the constituents of the rubber component or the crosslinking component, the proportions of the constituents are each defined as the proportion of the single type of ingredient.

Where an oil-extension type SBR is used, the proportion of the SBR described above is defined as the solid proportion of the SBR contained in the oil-extension type SBR.

(Epichlorohydrin Rubber)

Various types of polymers containing epichlorohydrin as a repetitive unit are usable as the epichlorohydrin rubber.

Specific examples of the epichlorohydrin rubber include epichlorohydrin homopolymers, epichlorohydrin-ethylene oxide bipolymers, epichlorohydrin-propylene oxide bipolymers, epichlorohydrin-allyl glycidyl ether bipolymers, epichlorohydrin-ethylene oxide-allyl glycidyl ether terpolymers, epichlorohydrin-propylene oxide-allyl glycidyl ether terpolymers and epichlorohydrin-ethylene oxide-propylene oxide-allyl glycidyl ether quaterpolymers, which may be used either alone or in combination.

Particularly, the ethylene oxide-containing epichlorohydrin copolymers are preferred as the epichlorohydrin rubber. The ethylene oxide-containing epichlorohydrin copolymers preferably each have an ethylene oxide content of 30 to 95 mol %, more preferably 55 to 95 mol %, particularly preferably 60 to 80 mol %.

Ethylene oxide functions to reduce the electrical resistance. If the ethylene oxide content is less than the aforementioned range, the electrical resistance reducing effect is reduced. If the ethylene oxide content is greater than the aforementioned range, on the other hand, ethylene oxide is liable to be crystallized, so that the segment motion of molecular chains is prevented to adversely increase the electrical resistance. Further, the roller body is liable to have an increased hardness after being crosslinked, and the electrically conductive rubber composition is liable to have an increased viscosity when being heated to be melted before the crosslinking.

Particularly, the epichlorohydrin-ethylene oxide bipolymers (ECO) are preferred as the epichlorohydrin rubber.

The ECO preferably has an ethylene oxide content of 30 to 80 mol %, particularly preferably 50 to 80 mol %, and preferably has an epichlorohydrin content of 20 to 70 mol %, particularly preferably 20 to 50 mol %.

It is also possible to use any of the epichlorohydrin-ethylene oxide-allyl glycidyl ether terpolymers (GECO) as the epichlorohydrin rubber.

The GECO preferably has an ethylene oxide content of 30 to 95 mol %, particularly preferably 60 to 80 mol %, and preferably has an epichlorohydrin content of 4.5 to 65 mol %, particularly preferably 15 to 40 mol %. Further, the GECO preferably has an allyl glycidyl ether content of 0.5 to 20 mol %, particularly preferably not less than 2 mol %.

Examples of the GECO include copolymers obtained by copolymerizing the three comonomers in a narrow sense, as well as known modification products obtained by modifying epichlorohydrin-ethylene oxide copolymers (ECO) with allyl glycidyl ether. In the present invention, any of these copolymers are usable.

Particularly, a GECO having an allyl glycidyl ether content of 2 to 20 mol % and a Mooney viscosity of 40 to 80 ML1+4 at 100° C.) is preferred as the epichlorohydrin rubber.

The proportion of the epichlorohydrin rubber to be blended is preferably not less than 10 parts by mass and not greater than 30 parts by mass based on 100 parts by mass of the rubber component.

If the proportion of the epichlorohydrin rubber is less than the aforementioned range, the developing roller is liable to have an increased roller resistance and, hence, provide a reduced toner charge level to reduce the image density of a formed image when being used for the developing. If the proportion of the epichlorohydrin rubber is greater than the aforementioned range, on the other hand, the roller body promotes the adhesion of the toner thereon, thereby adversely reducing the image density of a formed image. Further, the roller body is liable to have a reduced flexibility, thereby increasing the toner load.

(CR)

The CR is generally synthesized, for example, by emulsion polymerization of chloroprene, and is classified in a sulfur modification type or a non-sulfur-modification type depending on the type of a molecular weight adjusting agent to be used for the emulsion polymerization.

The sulfur modification type CR is prepared by plasticizing a copolymer of chloroprene and sulfur (molecular weight adjusting agent) with thiuram disulfide or the like to adjust the viscosity of the copolymer to a predetermined viscosity level.

The non-sulfur-modification type CR is classified, for example, in a mercaptan modification type, a xanthogen modification type or the like.

The mercaptan modification type CR is synthesized in substantially the same manner as the sulfur modification type CR, except that an alkyl mercaptan such as n-dodecyl mercaptan, tert-dodecyl mercaptan or octyl mercaptan, for example, is used as the molecular weight adjusting agent. The xanthogen modification type CR is synthesized in substantially the same manner as the sulfur modification type CR, except that an alkyl xanthogen compound is used as the molecular weight adjusting agent.

Further, the CR is classified in a lower crystallization speed type, an intermediate crystallization speed type or a higher crystallization speed type depending on the crystallization speed.

Further, a rubber of a copolymer of chloroprene and other comonomer may be used as the CR. Examples of the other comonomer include 2,3-dichloro-1,3-butadiene, 1-chloro-1,3-butadiene, styrene, acrylonitrile, methacrylonitrile, isoprene, butadiene, acrylic acid, acrylates, methacrylic acid and methacrylates, which may be used either alone or in combination.

Particularly, CRs of the higher crystallization speed type having a Mooney viscosity of 40 to 60 ML1+4 (at 100° C.) are preferred as the CR.

The proportion of the CR to be blended is a balance obtained by subtracting the proportions of the SBR and the epichlorohydrin rubber from the total of the rubber component. The proportion of the CR is determined so that the total amount of the SBR, the epichlorohydrin rubber and the CR is 100 parts by mass.

<Crosslinking Component>

In the present invention, the sulfur crosslinking agent, the thiourea accelerating agent, the thiuram accelerating agent and the thiazole accelerating agent are used as the crosslinking component for crosslinking the rubber component.

(Sulfur Crosslinking Agent)

Examples of the sulfur crosslinking agent include sulfur powder and organic sulfur-containing compounds. Examples of the organic sulfur-containing compounds include tetramethylthiuram disulfide and N,N-dithiobismorpholine. Particularly, sulfur is preferred.

The proportion of the sulfur crosslinking agent to be blended is limited to a range of not less than 1.0 part by mass and not greater than 1.5 parts by mass based on 100 parts by mass of the rubber component. By thus limiting the proportion of the sulfur crosslinking agent to the aforementioned range and limiting the proportions of the SBR and the other constituents of the crosslinking component to the specific ranges, the effects of the present invention previously described can be provided.

For further improvement of the effects, the proportion of the sulfur crosslinking agent is preferably not less than 1.2 parts by mass and not greater than 1.3 parts by mass within the aforementioned range based on 100 parts by mass of the rubber component.

(Thiourea Accelerating Agent)

Examples of the thiourea accelerating agent include tetramethylthiourea, trimethylthiourea, ethylene thiourea, and thioureas represented by $(C_nH_{2n+1}NH)_2C{=}S$ (wherein n is an integer of 1 to 10), which may be used either alone or in combination.

The proportion of the thiourea accelerating agent is limited to a range of not less than 0.2 parts by mass and not greater than 0.6 parts by mass based on 100 parts by mass of the rubber component. By thus limiting the proportion of the thiourea accelerating agent to the aforementioned range and limiting the proportions of the SBR and the other constituents of the crosslinking component to the specific ranges, the effects of the present invention previously described can be provided.

For further improvement of the effects, the proportion of the thiourea accelerating agent is preferably not less than 0.3 parts by mass and not greater than 0.5 parts by mass within the aforementioned range based on 100 parts by mass of the rubber component.

(Thiuram Accelerating Agent)

Examples of the thiuram accelerating agent include tetramethylthiuram monosulfide, tetramethylthiuram disulfide, tetraethylthiuram disulfide and dipentamethylenethiuram tetrasulfide, which may be used either alone or in combination.

The proportion of the thiuram accelerating agent is limited to a range of not less than 0.1 part by mass and not greater than 0.5 parts by mass based on 100 parts by mass of the rubber component. By thus limiting the proportion of the thiuram accelerating agent to the aforementioned range and limiting the proportions of the SBR and the other constituents of the crosslinking component to the specific ranges, the effects of the present invention previously described can be provided.

For further improvement of the effects, the proportion of the thiuram accelerating agent is preferably not less than 0.2 parts by mass and not greater than 0.4 parts by mass within the aforementioned range based on 100 parts by mass of the rubber component.

(Thiazole Accelerating Agent)

Examples of the thiazole accelerating agent include 2-mercaptobenzothiazole, di-2-benzothiazolyl disulfide, a zinc salt of 2-mercaptobenzothiazole, a cyclohexylamine salt of 2-mercaptobenzothiazole, 2-(N,N-dimethylthiocarbamoylthio)benzothiazole and 2-(4'-morpholinodithio)benzothiazole, which may be used either alone or in combination.

The proportion of the thiazole accelerating agent is limited to a range of not less than 1.0 part by mass and not greater than 2.0 parts by mass based on 100 parts by mass of the rubber component. By thus limiting the proportion of the thiazole accelerating agent to the aforementioned range and limiting the proportions of the SBR and the other constituents of the crosslinking component to the specific ranges, the effects of the present invention previously described can be provided.

For further improvement of the effects, the proportion of the thiazole accelerating agent is preferably not less than 1.3 parts by mass and not greater than 1.7 parts by mass within the aforementioned range based on 100 parts by mass of the rubber component.

(Other Ingredients for Crosslinking Component)

Since the effects of the present invention can be provided by using the sulfur crosslinking agent and the three types of accelerating agents in combination for the crosslinking component, there is basically no need to blend other ingredients for the crosslinking component. However, an acceleration assisting agent which assists reactions of the crosslinking agent and the accelerating agents may be used in combination with the crosslinking agent and the accelerating agents.

Examples of the acceleration assisting agent include metal compounds such as zinc white, fatty acids such as stearic acid, oleic acid and cotton seed fatty acids, and other conventionally known acceleration assisting agents, which may be used either alone or in combination.

The proportion of the acceleration assisting agent to be blended is preferably not less than 0.1 part by mass and not greater than 5 parts by mass, particularly preferably not less than 0.5 parts by mass and not greater than 2 parts by mass, based on 100 parts by mass of the rubber component.

<Other Components>

As required, various additives may be added to the electrically conductive rubber composition. Examples of the additives include an acid accepting agent, a plasticizing component (a plasticizer, a processing aid and the like), a degradation preventing agent, a filler, an anti-scorching agent, a UV absorbing agent, a lubricant, a pigment, an antistatic agent, a flame retarder, a neutralizing agent, a nucleating agent, a defoaming agent and a co-crosslinking agent.

In the presence of the acid accepting agent, chlorine-containing gases generated from the epichlorohydrin rubber during the crosslinking of the rubber component is prevented from remaining in the roller body. Thus, the acid accepting agent functions to prevent the inhibition of the crosslinking and the contamination of a photoreceptor body, which may otherwise be caused by the chlorine-containing gases.

Any of various substances serving as acid acceptors may be used as the acid accepting agent. Preferred examples of the acid accepting agent include hydrotalcites and Magsarat which are excellent in dispersibility. Particularly, the hydrotalcites are preferred.

Where any of the hydrotalcites is used in combination with magnesium oxide or potassium oxide, a higher acid accepting effect can be provided, thereby more reliably preventing the contamination of the photoreceptor body.

The proportion of the acid accepting agent to be blended is preferably not less than 0.2 parts by mass and not greater than 10 parts by mass, particularly preferably not less than 1 part by mass and not greater than 5 parts by mass, based on 100 parts by mass of the rubber component.

If the proportion of the acid accepting agent is less than the aforementioned range, it will be impossible to sufficiently provide the aforementioned effect of the blending of the acid accepting agent. If the proportion of the acid accepting agent is greater than the aforementioned range, the crosslinked roller body is liable to have an increased hardness.

Examples of the plasticizing agent include plasticizers such as dibutyl phthalate (DBP), dioctyl phthalate (DOP) and tricresyl phosphate, and waxes.

Examples of the processing aid include fatty acids such as stearic acid.

The proportion of the plasticizing component to be blended is preferably not greater than 5 parts by mass based on 100 parts by mass of the rubber component. This, for example, prevents the plasticizing component from bleeding onto the outer peripheral surface of the roller body when the oxide film is formed in the outer peripheral surface as required, and prevents the contamination of the photoreceptor body when the developing roller is mounted in an image forming apparatus or when the image forming apparatus is operated. For this purpose, it is particularly preferred to use a polar wax as the plasticizing component.

Examples of the degradation preventing agent include various anti-aging agents and anti-oxidants.

The anti-oxidants serve to reduce the environmental dependence of the roller resistance of the developing roller and to suppress increase in roller resistance during continuous energization of the developing roller. Examples of the anti-oxidants include nickel diethyldithiocarbamate (NOCRAC (registered trade name) NEC-P available from Ouchi Shinko Chemical Industrial Co., Ltd.) and nickel dibutyldithiocarbamate (NOCRAC NBC available from Ouchi Shinko Chemical Industrial Co., Ltd.)

Where the oxide film is to be formed in the outer peripheral surface of the roller body and any of the anti-oxidants is blended in the electrically conductive rubber composition, the proportion of the anti-oxidant to be blended is properly determined so as to ensure efficient formation of the oxide film.

Examples of the filler include zinc oxide, silica, carbon, carbon black, clay, talc, calcium carbonate, magnesium carbonate, aluminum hydroxide and titanium oxide, which maybe used either alone or in combination.

The mechanical strength and the like of the roller body can be improved by blending the filler. Further, the adhesion of the toner to the roller body can be suppressed by blending titanium oxide as the filler.

Electrically conductive carbon black may be used as the filler to impart the roller body with electrical conductivity.

In order to impart a nonporous roller body with excellent flexibility, for example, the proportion of the filler to be blended is preferably not greater than 50 parts by mass, particularly preferably not greater than 10 parts by mass, based on 100 parts by mass of the rubber component.

Examples of the anti-scorching agent include N-cyclohexylthiophthalimide, phthalic anhydride, N-nitrosodiphenylamine and 2,4-diphenyl-4-methyl-1-pentene, which may be used either alone or in combination. Particularly, N-cyclohexylthiophthalimide is preferred.

The proportion of the anti-scorching agent to be blended is preferably not less than 0.1 part by mass and not greater than 5 parts by mass, particularly preferably not greater than 1 part by mass, based on 100 parts by mass of the rubber component.

The co-crosslinking agent serves to crosslink itself as well as the rubber component to increase the overall molecular weight.

Examples of the co-crosslinking agent include ethylenically unsaturated monomers typified by methacrylates, metal salts of methacrylic acid and acrylic acid, polyfunctional polymers utilizing functional groups of 1,2-polybutadienes, and dioximes, which may be used either alone or in combination.

Examples of the ethylenically unsaturated monomers include:

(a) monocarboxylic acids such as acrylic acid, methacrylic acid and crotonic acid;

(b) dicarboxylic acids such as maleic acid, fumaric acid and itaconic acid;

(c) esters and anhydrides of the unsaturated carboxylic acids (a) and (b);

(d) metal salts of the monomers (a) to (c);

(e) aliphatic conjugated dienes such as 1,3-butadiene, isoprene and 2-chloro-1,3-butadiene;

(f) aromatic vinyl compounds such as styrene, α-methylstyrene, vinyltoluene, ethylvinylbenzene and divinylbenzene;

(g) vinyl compounds such as triallyl isocyanurate, triallyl cyanurate and vinylpyridine each having a hetero ring; and (h) cyanovinyl compounds such as (meth)acrylonitrile and α-chloroacrylonitrile, acrolein, formyl sterol, vinyl methyl ketone, vinyl ethyl ketone and vinyl butyl ketone. These ethylenically unsaturated monomers may be used either alone or in combination.

Monocarboxylic acid esters are preferred as the esters (c) of the unsaturated carboxylic acids.

Specific examples of the monocarboxylic acid esters include:

alkyl(meth)acrylates such as methyl(meth)acrylate, ethyl (meth)acrylate, n-propyl(meth)acrylate, i-propyl(meth)acrylate, n-butyl(meth)acrylate, i-butyl(meth)acrylate, n-pentyl (meth)acrylate, i-pentyl(meth)acrylate, n-hexyl(meth) acrylate, cyclohexyl(meth)acrylate, 2-ethylhexyl(meth) acrylate, octyl(meth)acrylate, i-nonyl(meth)acrylate, tert-butylcyclohexyl(meth)acrylate, decyl(meth)acrylate, dodecyl(meth)acrylate, hydroxymethyl(meth)acrylate and hydroxyethyl(meth)acrylate;

aminoalkyl(meth)acrylates such as aminoethyl(meth) acrylate, dimethylaminoethyl(meth)acrylate and butylaminoethyl(meth)acrylate;

(meth)acrylates such as benzyl(meth)acrylate, benzoyl (meth)acrylate and aryl(meth)acrylates each having an aromatic ring;

(meth)acrylates such as glycidyl(meth)acrylate, methaglycidyl(meth)acrylate and epoxycyclohexyl(meth)acrylate each having an epoxy group;

(meth)acrylates such as N-methylol(meth)acrylamide, γ-(meth)acryloxypropyltrimethoxysilane, tetrahydrofurfuryl methacrylate each having a functional group; and multifunctional(meth)acrylates such as ethylene glycol di(meth)acrylate, trimethylolpropane tri(meth)acrylate, ethylene dimethacrylate (EDMA), polyethylene glycol dimethacrylate and isobutylene ethylene dimethacrylate. These monocarboxylic acid esters may be used either alone or in combination.

The inventive electrically conductive rubber composition containing the aforementioned ingredients can be prepared in a conventional manner. First, the rubbers for the rubber component are blended in the predetermined proportions, and the resulting rubber component is simply kneaded. After additives other than the crosslinking component are added to and kneaded with the rubber component, the crosslinking component is finally added to and further kneaded with the resulting mixture. Thus, the electrically conductive rubber composition is provided. A kneader, a Banbury mixer, an extruder or the like, for example, is usable for the kneading.

<<Developing Roller and Image Forming Apparatus>>

FIG. 1 is a perspective view illustrating an exemplary developing roller according to an embodiment of the present invention.

Referring to FIG. 1, the developing roller 1 includes a tubular roller body 2 made of a crosslinking product of the inventive electrically conductive rubber composition, and a shaft 4 inserted through a center through-hole 3 of the roller body 2.

In order to Produce the developing roller 1 at the highest possible productivity at lower costs and to improve the durability of the roller body 2 and reduce the compression set of the roller body 2, it is preferred that the roller body 2 basically has a non-porous single layer structure as shown in FIG. 1.

Alternatively, the roller body 2 may have a double layer structure including an outer layer adjacent to an outer peripheral surface 5, and an inner layer adjacent to the shaft 4 in some case. In this case, at least the outer layer may be formed from the electrically conductive rubber composition. The roller body 2 may have a porous structure in some case.

The shaft 4 is a unitary member made of a metal such as aluminum, an aluminum alloy or a stainless steel. The roller body 2 and the shaft 4 are electrically connected and mechanically fixed to each other, for example, with an electrically conductive adhesive agent and, therefore, are unitarily rotatable.

The roller body 2 has an oxide film 6 formed in an outer peripheral surface 5 thereof as shown on a larger scale in FIG. 1. The oxide film 6 functions as a lower friction layer to suppress the adhesion of the toner and to reduce the toner load.

The developing roller 1 can be produced in a conventional manner by employing the inventive electrically conductive rubber composition containing the ingredients described above.

That is, the electrically conductive rubber composition is heated to be melted while being kneaded by means of an extruder. The melted rubber composition is extruded into an elongated tubular body through a die conformal to the sectional shape (annular sectional shape) of the roller body 2.

Then, the tubular body is cooled to be solidified, and then heated to be crosslinked in a vulcanization can with a temporary crosslinking shaft inserted through a through-hole 3 thereof.

In turn, the resulting tubular body is removed from the temporary shaft, and fitted around a shaft 4 having an outer peripheral surface to which an electrically conductive adhesive agent is applied. Where the adhesive agent is a thermosetting adhesive agent, the thermosetting adhesive agent is thermally cured to electrically connect and mechanically fix the roller body 2 to the shaft 4.

As required, the outer peripheral surface 5 of the roller body 2 is polished to a predetermined surface roughness, and then covered with an oxide film 6. Thus, the developing roller 1 shown in FIG. 1 is produced.

The oxide film 6 is formed by irradiating the crosslinked roller body with ultraviolet radiation in an oxidative atmosphere. That is, the crosslinking product of the electrically conductive rubber composition forming the outer peripheral surface 5 of the roller body 2 per se is oxidized by the irradiation with the ultraviolet radiation at a predetermined wavelength, whereby the oxide film 6 is formed in the outer peripheral surface 5.

At this time, a proper number of carbon-carbon double bonds remain in the roller body 2 formed from the inventive electrically conductive rubber composition before the irradiation with the ultraviolet radiation after the crosslinking. Therefore, the oxide film can be thus formed as having a sufficient thickness, a sufficient compactness and an excellent friction coefficient reducing effect in the outer peripheral surface of the roller body 2 by the irradiation with the ultraviolet radiation for the shortest possible period of time as previously described.

The wavelength of the ultraviolet radiation for the irradiation is preferably not less than 100 nm and not greater than 400 nm, particularly preferably not greater than 300 nm, in order to efficiently oxidize the rubber component for the formation of the highly functional oxide film 6. The irradiation period is preferably not shorter than 30 seconds and not longer than 30 minutes, particularly preferably not shorter than 1 minute and not longer than 15 minutes.

The developing roller 1 is incorporated in an electrophotographic image forming apparatus such as a laser printer, and advantageously used for developing an electrostatic latent image formed on a surface of a photoreceptor body into a toner image with an electrically charged toner.

The roller body 2 is flexible because the rubber component includes the SBR and, in addition, the oxide film 6 formed in the outer peripheral surface of the roller body 2 by the irradiation with the ultraviolet radiation is excellent in friction coefficient reducing effect. Therefore, the roller body 2 is excellent in toner load reducing effect, free from the contamination of the photoreceptor body, and substantially free from permanent compressive deformation with a smaller compression set.

With the developing roller 1, it is possible to further reduce the size of a cartridge incorporating the developing roller 1 for a higher durability laser printer, and the size of an image forming apparatus such as a laser printer in which the cartridge is removably mounted.

The roller body 2 preferably has a thickness of not less than 0.5 mm and not greater than 10 mm, more preferably not less than 1 mm and not greater than 7 mm, particularly preferably not less than 2 mm and not greater than 5 mm, in order to provide a proper nip width while reducing the diameter and the weight of the developing roller.

Examples of the image forming apparatus in which the inventive developing roller is incorporated include various electrophotographic image forming apparatuses such as laser printers, electrostatic copying machines, plain paper facsimile machines and printer-copier-facsimile multifunction machines. In any of these image forming apparatuses, the diameter of the developing roller 1 and the size of the cartridge can be reduced. This permits the size reduction of the entire image forming apparatuses.

EXAMPLES

Example 1

Preparation of Electrically Conductive Rubber Composition

A rubber component was prepared by blending 60 parts by mass of SER (non-oil-extension type SBR JSR1502 available from JSR Co., Ltd.), 20 parts by mass of GECO (EPION (registered trade name) ON301 available from Daiso Co., Ltd. and having a molar ratio of EO/EP/AGE=73/23/4) and 20 parts by mass of CR (SHOPRENE (registered trade name) WRT available from Showa Denko K.K.)

While 100 parts by mass of the rubber component was simply kneaded by a Banbury mixer, ingredients shown below in Table 1 except for a crosslinking component were added to and kneaded with the rubber component. Finally, the crosslinking component was added to and kneaded with the resulting mixture. Thus, an electrically conductive rubber composition was prepared.

TABLE 1

| Ingredients | Parts by mass |
|---|---|
| Sulfur crosslinking agent | 1.25 |
| Thiourea accelerating agent | 0.4 |
| Thiuram accelerating agent | 0.3 |
| Thiazole accelerating agent | 1.5 |
| Acceleration assisting agent | 5.0 |
| Filler | 2.0 |
| Acid accepting agent | 3.0 |

The ingredients shown in Table 1 are as follows:

Sulfur crosslinking agent: Sulfur powder

Thiourea accelerating agent: Ethylene thiourea (2-mercaptoimidazoline ACCEL (registered trade name) 22-S available from Kawaguchi Chemical Industry Co., Ltd.)

Thiuram accelerating agent: Tetramethylthiuram monosulfide (NOCCELER (registered trade name) TS available from Ouchi Shinko Chemical Industrial Co., Ltd.)

Thiazole accelerating agent: Di-2-benzothiazolyl disulfide (NOCCELER DM available from Ouchi Shinko Chemical Industrial Co., Ltd.)

Acceleration assisting agent: Zinc white (ZINC OXIDE TYPE-2 available from Mitsui Mining & Smelting Co., Ltd.)

Filler: Electrically conductive carbon black (DENKA BLACK (registered trade name) available from Denki Kagaku Kogyo K.K.)

Acid accepting agent: Hydrotalcites (DHT-4A (registered trade name) 2 available from Kyowa Chemical Industry Co., Ltd.)

The amounts (parts by mass) of the respective ingredients shown in Table 1 are based on 100 parts by mass of the rubber component.

(Production of Developing Roller)

The rubber composition thus prepared was fed into an extruder and then extruded into a tubular body having an outer diameter of 16 mm and an inner diameter of 5 to 5.5 mm. Then, the tubular body was fitted around a temporary crosslinking shaft having an outer diameter of 3 mm, and crosslinked at 160° C. for 1 hour in a vulcanization can.

Subsequently, the tubular body was removed from the temporary shaft, then fitted around a shaft having an outer diameter of 6 mm and an outer peripheral surface to which an electrically conductive thermosetting adhesive agent was applied, and heated to 160° C. in an oven. Thus, the tubular body was fixed to the shaft. Thereafter, opposite end portions of the tubular body were trimmed, and the outer peripheral surface of the tubular body was polished by a traverse polishing process utilizing a cylindrical polisher and then by a mirror polishing process to be thereby finished as having an outer diameter of 13 mm (with a tolerance of 0.05). Thus, a roller body combined with the shaft was produced.

Then, the polished outer peripheral surface of the roller body was rinsed with water, and the roller body was set in a UV irradiation apparatus (PL21-200 available from Sen Lights Corporation) with its outer peripheral surface spaced 5 cm from a UV lamp. While the roller body was automatically rotated, the outer peripheral surface of the roller body was entirely irradiated with ultraviolet radiation at a wavelength of 184. 9 nm for a total period of 15 minutes. Thus, an oxide film was formed in the outer peripheral surface of the roller body. In this manner, a developing roller was produced.

Example 2

An electrically conductive rubber composition was prepared in substantially the same manner as in Example 1, except that the proportions of the SBR, the GECO and the CR for the rubber component were 40 parts by mass, 30 parts by mass and 30 parts by mass, respectively. Then, a developing roller was produced by using the electrically conductive rubber composition thus prepared.

Example 3

An electrically conductive rubber composition was prepared in substantially the same manner as in Example 1, except that the proportions of the SBR, the GECO and the CR for the rubber component were 80 parts by mass, 10 parts by mass and 10 parts by mass, respectively. Then, a developing roller was produced by using the electrically conductive rubber composition thus prepared.

Comparative Example 1

An electrically conductive rubber composition was prepared in substantially the same manner as in Example 1, except that the proportions of the SBR, the GECO and the CR for the rubber component were 35 parts by mass, 32.5 parts by mass and 32.5 parts by mass, respectively. Then, a developing roller was produced by using the electrically conductive rubber composition thus prepared.

Comparative Example 2

An electrically conductive rubber composition was prepared in substantially the same manner as in Example 1, except that the proportions of the SBR, the GECO and the CR for the rubber component were 85 parts by mass, 7.5 parts by mass and 7.5 parts by mass, respectively. Then, a developing roller was produced by using the electrically conductive rubber composition thus prepared.

Examples 4 and 5

And Comparative Examples 3 and 4

Electrically conductive rubber compositions were prepared in substantially the same manner as in Example 1, except that the proportions of sulfur as the sulfur crosslinking agent were 0.9 parts by mass (Comparative Example 3), 1.0 part by mass (Example 4), 1.5 parts by mass (Example 5) and 1.6 parts by mass (Comparative Example 4). Then, developing rollers were respectively produced by using the electrically conductive rubber compositions thus prepared.

Examples 6 and 7

And Comparative Examples 5 and 6

Electrically conductive rubber compositions were prepared in substantially the same manner as in Example 1, except that the proportions of the thiazole accelerating agent were 0.9 parts by mass (Comparative Example 5), 1.0 part by mass (Example 6), 2.0 parts by mass (Example 7) and 2.1 parts by mass (Comparative Example 6). Then, developing rollers were respectively Produced by using the electrically conductive rubber compositions thus prepared.

Examples 8 and 9

And Comparative Examples 7 and 8

Electrically conductive rubber compositions were prepared in substantially the same manner as in Example 1, except that the proportions of the thiuram accelerating agent were 0.05 parts by mass (Comparative Example 7), 0.1 part by mass (Example 8), 0.5 parts by mass (Example 9) and 0.55 parts by mass (Comparative Example 8). Then, developing rollers were respectively produced by using the electrically conductive rubber compositions thus prepared.

Examples 10 and 11

And Comparative Examples 9 and 10

Electrically conductive rubber compositions were prepared in substantially the same manner as in Example 1, except that the proportions of the thiourea accelerating agent were 0.1 part by mass (Comparative Example 9), 0.2 parts by mass (Example 10), 0.6 parts by mass (Example 11) and 0.7 parts by mass (Comparative Example 10). Then, developing rollers were respectively produced by using the electrically conductive rubber compositions thus prepared.

Comparative Example 11

An electrically conductive rubber composition was prepared in substantially the same manner as in Example 1, except that the rubber component was prepared by blending 50 parts by mass of the SBR, 20 parts by mass of the GECO and 30 parts by mass of the CR, that 0.75 parts by mass of sulfur, 0.5 parts by mass of the thiazole accelerating agent, 1.0 part by mass of the thiuram accelerating agent, 0.85 parts by mass of the thiourea accelerating agent, 5.0 parts by mass of the electrically conductive carbon black as the filler and 3.0 parts by mass of the acid accepting agent based on 100 parts by mass of the rubber component were blended, and that 0.8 parts by mass of 1,3-di-o-tolylguanidine (NOCCELER DT available from Ouchi Shinko Chemical Industrial Co., Ltd.) based on 100 parts by mass of the rubber component was additionally blended as a guanidine accelerating agent and zinc oxide was not blended as the acceleration assisting agent. Then, a developing roller was produced by using the electrically conductive rubber composition thus prepared. This developing roller corresponds to Example 3 of Patent Literature 1.

<Measurement of Mass Change Percentage>

The number of carbon-carbon double bonds remaining in the roller body before the irradiation with the ultraviolet radiation after the crosslinking was evaluated based on amass change percentage determined by using toluene.

More specifically, a test strip specified in the Japanese Industrial Standards JIS K6258:2003 "Rubber, vulcanized or thermoplastic—Determination of the effect of liquids" was cut out from each of the roller bodies produced in Examples and Comparative Examples before the irradiation with the ultraviolet radiation, and immersed in toluene. The mass change percentage of the test strip was determined at a temperature of 23° C. in conformity with a measurement method specified in JIS K6258. The evaluation was made based on the fact that the number of carbon-carbon double bonds remaining in the roller body is increased as the mass change percentage increases.

Here, a test strip having a mass change percentage of not less than 300% is rated as acceptable (○), and a test strip having a mass change percentage of less than 300% is rated as unacceptable (x).

<Measurement of Compression Set Percentage>

A large-size test strip specified in the Japanese Industrial Standards JIS K6262:2006 "Rubber, vulcanized or thermoplastic—Determination of compression set at ambient, elevated or low temperatures" was prepared from each of the rubber compositions prepared in Examples and Comparative Examples. A compression test was performed on the test strip at a test temperature of 70±1° C. for a test period of 22 hours.

A compression set percentage CS (%) was calculated from the following expression (1):

$$CS=t_0-t_2/t_0-t_1 \quad (1)$$

wherein $t_0$ is the thickness of the test strip before the compression, $t_1$ is the thickness of a spacer used for the compression, and $t_2$ is the thickness of the test strip after a lapse of 30 minutes from decompression of the test strip.

The roller bodies made of the crosslinking products of the respective rubber compositions described above were each evaluated for the compression set based on the following criteria:

Acceptable (○): The compression set percentage was not greater than 10%.

Unacceptable (x): The compression set percentage was greater than 10%.

<Measurement of Friction Coefficient>

A TEFLON (registered trade name) sheet was placed on a horizontal surface of an aluminum plate in an ordinary temperature and ordinary humidity environment at a temperature of 23° C. at a relative humidity of 55%. Then, the developing rollers produced in Examples and Comparative Examples were each fixed on the TEFLON sheet with the intervention of a PET shoot so as not to be rotated. Thus, the developing roller was kept in press contact with the PET sheet by its gravity.

Then, a spring balance was connected to one end of the PET sheet, and pulled perpendicularly to the axis of the developing roller within the plane of the plate. A tensile force F occurring at this time was measured.

The friction coefficient μ was calculated from the following expression (2):

$$\mu=F/N \quad (2)$$

wherein F is the tensile force, and N=[mass (g) of developing roller]×0.001×9.8.

The PET sheet was dimensioned such that the roller body of the developing roller was not moved out of the PET sheet into direct contact with the surface of the TEFLON sheet during the test.

A developing roller having a friction coefficient μ of not greater than 0.10 is rated as acceptable (○), and a developing roller having a friction coefficient μ of greater than 0.10 is rated as unacceptable (x).

<Evaluation against Photoreceptor Contamination>

The developing rollers produced in Examples and Comparative Examples were each incorporated in a commercially available cartridge instead of an originally incorporated developing roller, and then the cartridge was mounted in a commercially available laser printer.

After a monochromatic solid image and a half tone image were formed in an ordinary temperature and ordinary humidity environment at a temperature of 23° C. at a relative humidity of 55% by the laser printer, the cartridge was taken out of the laser printer and allowed to stand in an environment at a temperature of 50° C. at a relative humidity of 90% for one week. Thereafter, the cartridge was mounted again in the laser printer, and a monochromatic solid image and a half tone image were formed in the ordinary temperature and ordinary humidity environment at a temperature of 23° C. at a relative humidity of 55% by the laser printer. A developing roller which did not contaminate a photoreceptor body so that the formed images were free from a contamination line is rated as excellent (○), and a developing roller which contaminated a photoreceptor body so that the formed images suffered from a contamination line is rated as unacceptable (x).

The results are shown in Tables 2 to 5.

TABLE 2

| | Example 1 | Example 2 | Example 3 | Example 4 | Example 5 | Example 6 |
|---|---|---|---|---|---|---|
| | Parts by mass | | | | | |
| SBR | 60 | 40 | 80 | 60 | 60 | 60 |
| GECO | 20 | 30 | 10 | 20 | 20 | 20 |
| CR | 20 | 30 | 10 | 20 | 20 | 20 |
| Sulfur crosslinking agent | 1.25 | 1.25 | 1.25 | 1.0 | 1.5 | 1.25 |
| Thiourea accelerating agent | 0.4 | 0.4 | 0.4 | 0.4 | 0.4 | 0.4 |
| Thiuram accelerating agent | 0.3 | 0.3 | 0.3 | 0.3 | 0.3 | 0.3 |
| Thiazole accelerating agent | 1.5 | 1.5 | 1.5 | 1.5 | 1.5 | 1.0 |

TABLE 2-continued

| | | Example 1 | Example 2 | Example 3 | Example 4 | Example 5 | Example 6 |
|---|---|---|---|---|---|---|---|
| Evaluation | | | | | | | |
| Mass change percentage (%) | Value | 330 | 305 | 380 | 350 | 305 | 320 |
| | Evaluation | ○ | ○ | ○ | ○ | ○ | ○ |
| Compression set percentage (%) | Value | 8.5 | 9.7 | 9.0 | 9.8 | 8.2 | 9.8 |
| | Evaluation | ○ | ○ | ○ | ○ | ○ | ○ |
| Friction coefficient | Value | 0.09 | 0.09 | 0.07 | 0.08 | 0.09 | 0.09 |
| | Evaluation | ○ | ○ | ○ | ○ | ○ | ○ |
| Contamination of photoreceptor body | | ○ | ○ | ○ | ○ | ○ | ○ |

TABLE 3

| | | Example 7 | Example 8 | Example 9 | Example 10 | Example 11 |
|---|---|---|---|---|---|---|
| Parts by mass | | | | | | |
| SBR | | 60 | 60 | 60 | 60 | 60 |
| GECO | | 20 | 20 | 20 | 20 | 20 |
| CR | | 20 | 20 | 20 | 20 | 20 |
| Sulfur crosslinking agent | | 1.25 | 1.25 | 1.25 | 1.25 | 1.25 |
| Thiourea accelerating agent | | 0.4 | 0.4 | 0.4 | 0.2 | 0.6 |
| Thiuram accelerating agent | | 0.3 | 0.1 | 0.5 | 0.3 | 0.3 |
| Thiazole accelerating agent | | 2.0 | 1.5 | 1.5 | 1.5 | 1.5 |
| Evaluation | | | | | | |
| Mass change percentage (%) | Value | 340 | 390 | 310 | 340 | 350 |
| | Evaluation | ○ | ○ | ○ | ○ | ○ |
| Compression set percentage (%) | Value | 8.9 | 9.7 | 8.4 | 8.4 | 9.8 |
| | Evaluation | ○ | ○ | ○ | ○ | ○ |
| Friction coefficient | Value | 0.09 | 0.07 | 0.09 | 0.09 | 0.09 |
| | Evaluation | ○ | ○ | ○ | ○ | ○ |
| Contamination of photoreceptor body | | ○ | ○ | ○ | ○ | ○ |

TABLE 4

| | | Comparative Example 1 | Comparative Example 2 | Comparative Example 3 | Comparative Example 4 | Comparative Example 5 | Comparative Example 6 |
|---|---|---|---|---|---|---|---|
| Parts by mass | | | | | | | |
| SBR | | 35 | 85 | 60 | 60 | 60 | 60 |
| GECO | | 32.5 | 7.5 | 20 | 20 | 20 | 20 |
| CR | | 32.5 | 7.5 | 20 | 20 | 20 | 20 |
| Sulfur crosslinking agent | | 1.25 | 1.25 | 0.9 | 1.6 | 1.25 | 1.25 |
| Thiourea accelerating agent | | 0.4 | 0.4 | 0.4 | 0.4 | 0.4 | 0.4 |
| Thiuram accelerating agent | | 0.3 | 0.3 | 0.3 | 0.3 | 0.3 | 0.3 |
| Thiazole accelerating agent | | 1.5 | 1.5 | 1.5 | 1.5 | 0.9 | 2.1 |
| Evaluation | | | | | | | |
| Mass change percentage (%) | Value | 280 | 370 | 370 | 285 | 320 | 310 |
| | Evaluation | x | ○ | ○ | x | ○ | ○ |
| Compression set percentage (%) | Value | 8.2 | 9.8 | 11.5 | 8.1 | 11.1 | 8.1 |
| | Evaluation | ○ | ○ | x | ○ | x | ○ |
| Friction coefficient | Value | 0.13 | 0.07 | 0.07 | 0.12 | 0.09 | 0.09 |
| | Evaluation | x | ○ | ○ | x | ○ | ○ |
| Contamination of photoreceptor body | | ○ | x | ○ | ○ | ○ | x |

TABLE 5

| | Comparative Example 7 | Comparative Example 8 | Comparative Example 9 | Comparative Example 10 | Comparative Example 11 |
|---|---|---|---|---|---|
| Parts by mass | | | | | |
| SBR | 60 | 60 | 60 | 60 | 50 |
| GECO | 20 | 20 | 20 | 20 | 20 |
| CR | 20 | 20 | 20 | 20 | 30 |
| Sulfur crosslinking agent | 1.25 | 1.25 | 1.25 | 1.25 | 0.75 |
| Thiourea accelerating agent | 0.4 | 0.4 | 0.1 | 0.7 | 0.85 |

TABLE 5-continued

| | | Comparative Example 7 | Comparative Example 8 | Comparative Example 9 | Comparative Example 10 | Comparative Example 11 |
|---|---|---|---|---|---|---|
| Thiuram accelerating agent | | 0.05 | 0.55 | 0.3 | 0.3 | 1.0 |
| Thiazole accelerating agent | | 1.5 | 1.5 | 1.5 | 1.5 | 0.5 |
| | | Evaluation | | | | |
| Mass change percentage (%) | Value | 350 | 280 | 340 | 370 | 260 |
| | Evaluation | ○ | x | ○ | ○ | x |
| Compression set percentage (%) | Value | 12.1 | 8.9 | 9.8 | 11.0 | 12.5 |
| | Evaluation | x | ○ | ○ | x | x |
| Friction coefficient | Value | 0.08 | 0.12 | 0.09 | 0.07 | 0.13 |
| | Evaluation | ○ | x | ○ | ○ | x |
| Contamination of photoreceptor body | | ○ | ○ | x | ○ | ○ |

The results for Examples 1 to 3 and Comparative Examples 1, 2 and 11 shown in Tables 2, 4 and 5 indicate that, in order to provide the effects of the present invention, the proportion of the styrene butadiene rubber should be not less than 40 parts by mass and not greater than 80 parts by mass, particularly preferably not less than 50 parts by mass, based on 100 parts by mass of the rubber component.

The results for Examples 1, 4 and 5 and Comparative Examples 3, 4 and 11 shown in Tables 2, 4 and 5 indicate that the proportion of the sulfur crosslinking agent should be not less than 1.0 part by mass and not greater than 1.5 parts by mass, particularly preferably not less than 1.2 parts by mass and not greater than 1.3 parts by mass, based on 100 parts by mass of the rubber component.

The results for Examples 1, 6 and 7 and Comparative Examples 5, 6 and 11 shown in Tables 2, 3, 4 and 5 indicate that the proportion of the thiazole accelerating agent should be not less than 1.0 part by mass and not greater than 2.0 parts by mass, particularly preferably not less than 1.3 parts by mass and not greater than 1.7 parts by mass, based on 100 parts by mass of the rubber component.

The results for Examples 1, 8 and 9 and Comparative Examples 7, 8 and 11 shown in Tables 2, 3 and 5 indicate that the proportion of the thiuram accelerating agent should be not less than 0.1 part by mass and not greater than 0.5 parts by mass, particularly preferably not less than 0.2 parts by mass and not greater than 0.4 parts by mass, based on 100 parts by mass of the rubber component.

The results for Examples 1, 10 and 11 and Comparative Examples 9 to 11 shown in Tables 2, 3 and 5 indicate that the proportion of the thiourea accelerating agent should be not less than 0.2 parts by mass and not greater than 0.6 parts by mass, particularly preferably not less than 0.3 parts by mass and not greater than 0.5 parts by mass, based on 100 parts by mass of the rubber component.

This application corresponds to Japanese Patent Application No. 2012-227242 filed in the Japan Patent Office on Oct. 12, 2012, the disclosure of which is incorporated herein by reference in its entirety.

What is claimed is:

1. An electrically conductive rubber composition, comprising:

a rubber component; and a crosslinking component for crosslinking the rubber component;

wherein the rubber component comprises three types of rubbers including a styrene butadiene rubber, an epichlorohydrin rubber and a chloroprene rubber, and the styrene butadiene rubber is present in a proportion of not less than 40 parts by mass and not greater than 80 parts by mass based on 100 parts by mass of the rubber component;

wherein the crosslinking component comprises not less than 1.0 part by mass and not greater than 1.5 parts by mass of a sulfur crosslinking agent, not less than 0.2 parts by mass and not greater than 0.6 parts by mass of a thiourea accelerating agent, not less than 0.1 part by mass and not greater than 0.5 parts by mass of a thiuram accelerating agent, and not less than 1.0 part by mass and not greater than 2.0 parts by mass of a thiazole accelerating agent.

2. A developing roller comprising a tubular roller body made of a crosslinking product of the electrically conductive rubber composition according to claim 1 and having an oxide film formed in an outer peripheral surface thereof by irradiation with ultraviolet radiation.

3. An image forming apparatus comprising the developing roller according to claim 2.

* * * * *